US005863254A

United States Patent [19]

Kozar

[11] Patent Number: 5,863,254

[45] Date of Patent: Jan. 26, 1999

[54] VISUAL AID FOR DESCRIBING SPORTING EVENTS

[76] Inventor: William Kozar, 2729 Wakefield, Westlake, Ohio 44145

[21] Appl. No.: 958,714

[22] Filed: Nov. 17, 1997

[51] Int. Cl.[6] ..... A63F 3/00

[52] U.S. Cl. ..... 473/54; 273/240

[58] Field of Search ..... 473/54; 273/240; 283/49, 50, 115

[56] References Cited

U.S. PATENT DOCUMENTS

| | | | |
|---|---|---|---|
| 1,932,524 | 10/1933 | Jackson, Jr. | 273/240 |
| 3,024,043 | 3/1962 | Lyman et al. | 473/240 |
| 3,170,719 | 2/1965 | Kraus | 473/54 |
| 3,181,865 | 5/1965 | Tout | 273/240 |
| 5,273,290 | 12/1993 | Cole et al. | 273/240 |

*Primary Examiner*—William M. Pierce

[57] ABSTRACT

A visual aid for describing sporting events (10) having a transparent event sheet (12) which has an event sheet indicia printed thereon. An opaque sheet (14) positioned under the event sheet (12). The visual aid for describing sporting events (10) further has a board (16) which has dark colored board wax (16A) covering a board support (16B). The dark colored board wax (16A) is positioned under the opaque sheet (14). The visual aid for describing sporting events (10) further has a binding (18) positioned longitudinally along one edge of the visual aid for describing sporting events (10). The binding (18) securely attaches the event sheet (12) and the opaque sheet (14) and the board (16) together. When a user applies pressure with a writing instrument on the event sheet (12). The pressure causes the dark colored board wax (16A) to adhere to the opaque sheet (14) exhibiting the writing through the transparent event sheet (12). When the user is finished writing, he or she separates the opaque sheet (14) from the board (16) thereby erasing the writing.

3 Claims, 2 Drawing Sheets

VISUAL AID FOR DESCRIBING SPORTING EVENTS

BACKGROUND OF THE INVENTION

1. Field of the Invention

The present invention relates to event planning. More particularly, the present invention relates to sporting event planning utilizing a writing instrument.

2. Description of the Prior Art

Writing aids are well known in the art. However, erasable writing aids which allow a user to visually describe or teach a sporting event are non-existent. Most prior art devices utilize a black board or easel with paper. The present invention is easy to use and compact.

Numerous innovations for sports writing aid have been provided in the prior art that are described as follows. Even though these innovations may be suitable for the specific individual purposes to which they address, they differ from the present invention as hereinafter contrasted.

In Patent number D327,498, titled Drawing Screen, invented by James E. Watson and Thomas A. Molyneaux, an ornamental design for a drawing screen, as shown and described.

The patented invention differs from the present invention because the patented invention is an ornamental design for a drawing screen. The patented invention lacks features similar to the present invention. Specifically the patented invention lacks the combination of three sheet functioning to provide an erasable drawing.

In U.S. Pat. No. 5,115,330, titled Liquid Crystal Writing Slate, invented by Frederick E. Nobile, John F. Harris, III, Gary S. Silverman, Richard A. Baumann, a slate, such as a writing/drawing slate, includes a base supporting a laminate which has an LC-layer (liquid crystal layer) formed of polymeric material holding micro-volumes of liquid crystal material, a conductive layer on one surface of the LC-layer, and a substantially transparent protective over layer on the other surface of the LC-layer, apparatus for transitory application of potential through the LC-layer to the conductive layer to produce an image on the image-displaying surface area, and apparatus secured to the base to facilitate erasing of the image. In preferred embodiments the other surface of the LC-layer is substantially conductor-free.

The patented invention differs from the present invention because the patented invention is electro-mechanical writing tablet. The present invention is a mechanical device on which a user can sketch various sports diagrams such as football plays, bowling ball rolls, tennis serves, basketball plays, sailboat tactics. The present invention is a top clear sheet imprinted with indicia representing sports layout. A middle sheet which when pressed on with a sharp instrument on the top surface, interacts with a lower sheet to leave an apparent mark. When the middle sheet is separated from the lower sheet the line is erased. A ridged back supports the three sheets.

In U.S. Pat. No. 4,839,634, titled Electro-optic Slate for Input/output of Hand-entered Textual and Graphic Information, invented by Edward S. More, John C. Aiken, a portable interactive electro-optic data input/output, storage, processing, and display device responsive to hand printed text and hand drawn graphics. The device preferably comprises a combined flat panel display and pen sensing surface constructed from non-mechanical, non-emissive display elements, such as liquid crystal display elements. The device also comprises an input pen for manual entry of hand printed text and hand drawn graphics, as well as commands, directly onto the display surface for providing an electronic writing and drawing slate. The display elements themselves are preferably utilized as input pen sense locations. The flat panel display and pen sensing surface is constructed so that there is no display distortion when the input pen is in contact with the surface. Rapid input pen sensing is provided for accommodating natural pen movement on a high resolution, large area display. A character recognition method is also associated with the device for automatic and computationally efficient on-line recognition of hand printed text characters, while accommodating a natural printing style. Hand printed text characters are recognized and preferably stored in a compact and standardized format, such as ASCII, for later display, processing, or output to external equipment, such as a printer or computer. Graphics can also be entered and stored for later display, processing, or output to an external device, and graphics can be interspersed with text, if desired. Also, text and graphics can preferably be input to the device from external information processing equipment for display and/or processing.

The patented invention differs from the present invention because the patented invention is a electro-optic data input/output, storage, processing, and display device which translated handwritten text and graphics into text and digitized drawings. The text and drawings maybe save as a permanent record and printed at a later time. The present invention is a mechanical device for drawing which does not provide a permanent record. Further, the drawings cannot be printed.

Numerous innovations for sports writing aid have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a portable writing aid providing visual instructions when teaching or coaching various sports. The device consists of a plastic sheet imprinted with an appropriate sport layout (ie. Bowling alley) and a wax writing slate modified to specific dimensions. It is bound along the top or side to a rigid backboard to which is affixed a writing utensil. During operation, utilizing the writing utensil, the instructions or directions can be displayed. When no longer needed, the top sheet is lifted to remove the writing and the device is now ready for the next set of directions.

The types of problems encountered in the prior art are writing aids are too cumbersome and hard to utilize.

In the prior art, unsuccessful attempts to solve this problem were attempted namely: black boards and easels. However, the problem was solved by the present invention because it is compact and allows instant erasure by simply separating the sheets.

Innovations within the prior art are rapidly being exploited in the field of sport teaching events.

The present invention went contrary to the teaching of the art which describes and teaches billboards and easels.

The present invention solved a long felt need for a compact easy to use erasable sports teaching aid.

A synergistic effect was produced utilizing the present invention due to the following facts and results from experimentation: higher bowling averages were achieved utilizing the present invention as compared with previous techniques.

Accordingly, it is an object of the present invention to provide a visual aid for describing sporting events having an event sheet, an opaque sheet, and a binding.

More particularly, it is an object of the present invention to provide the event sheet which comprises an event sheet bowling alley, an event sheet bowling pin, an event sheet forward bowling ball marker, an event sheet rearward bowling ball marker, and an event sheet foul line.

In keeping with these objects, and with others which will become apparent hereinafter, one feature of the present invention resides, briefly stated, in the event sheet foul line comprising an event sheet foul line marker, an event sheet second foul line marker, and an event sheet first foul line marker.

When the board is designed in accordance with the present invention, it comprises a board wax over a support.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—visual aid for describing sporting events (10)
12—event sheet (12)
12A—event sheet bowling alley (12A)
12B—event sheet bowling pin (12B)
12C—event sheet forward bowling ball marker (12C)
12D—event sheet rearward bowling ball marker (12D)
12E—event sheet foul line (12E)
12EA—event sheet foul line marker (12EA)
12EB—event sheet second foul line marker (12EB)
12EC—event sheet first foul line marker (12EC)
14—opaque sheet (14)
16—board (16)
16A—board wax (16A)
16B—board support (16B)
18—binding (18)

DESCRIPTION OF THE PREFERRED EMBODIMENT

Figure 1:
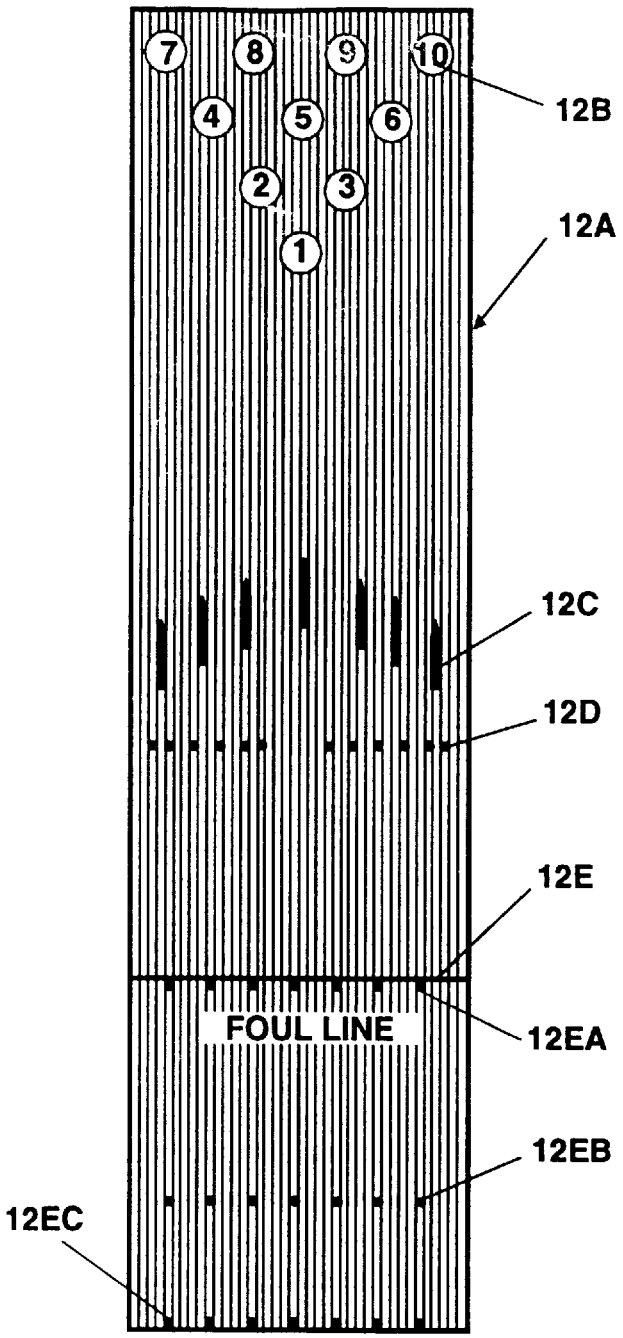
FIG. 1 is a top view of an event sheet.

Firstly, referring to FIG. 1 which is a top view of an event sheet (12). The event sheet (12) further comprises a event sheet bowling alley (12A) having at least one event sheet bowling pin (12B) and a event sheet foul line (12E). The event sheet (12) further comprises at least one event sheet forward bowling ball marker (12C). The event sheet (12) further comprises at least one event sheet rearward bowling ball marker (12D). The event sheet foul line (12E) further comprises at least one event sheet foul line marker (12EA). The event sheet foul line (12E) further comprises at least one event sheet second foul line marker (12EB). The event sheet foul line (12E) further comprises at least one event sheet first foul line marker (12EC).

Figure 2:
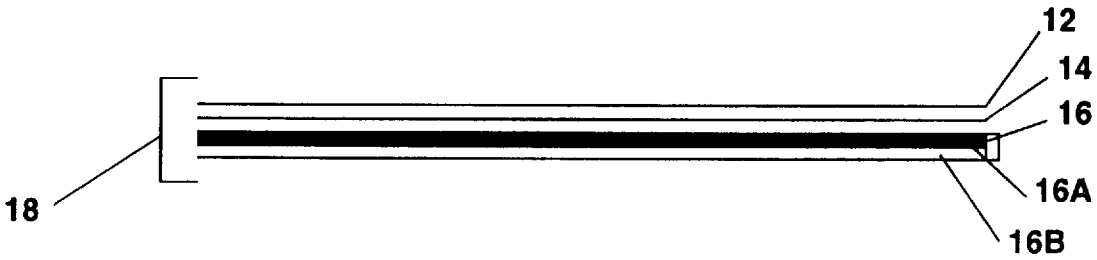
FIG. 2 is a side view of a visual aid for describing sporting events.

Referring to FIG. 2 which is a side view of a visual aid for describing sporting events (10) comprising a transparent event sheet (12) which comprises an event sheet indicia printed thereon. An opaque sheet (14) positioned under the event sheet (12). The visual aid for describing sporting events (10) further comprises a board (16) which comprises dark colored board wax (16A) covering a board support (16B). The dark colored board wax (16A) is positioned under the opaque sheet (14).

The visual aid for describing sporting events (10) further comprises a binding (18) positioned longitudinally along one edge of the visual aid for describing sporting events (10). The binding (18) securely attaches the event sheet (12) and the opaque sheet (14) and the board (16) together. When a user applies pressure with a writing instrument on the event sheet (12). The pressure causes the dark colored board wax (16A) to adhere to the opaque sheet (14) exhibiting the writing through the transparent event sheet (12). When the user is finished writing, he or she separates the opaque sheet (14) from the board (16) thereby erasing the writing.

The event sheet (12) and the opaque sheet (14) are manufactured from plastic or plastic composite. The board support (16B) is manufactured from a material selected from a group consisting of plastic, plastic composite, metal, metal alloy, wood, wood composite, cardboard, rubber, rubber composite, fiberglass, epoxy, and carbon-graphite.

It will be understood that each of the elements described above, or two or more together, may also find a useful application in other types of constructions differing from the type described above.

While the invention has been illustrated and described as embodied in a sports writing aid, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A visual aid for describing sporting events (10) comprising:

A) a transparent event sheet (12) which comprises an event sheet indicia printed thereon, the event sheet (12) further comprises a event sheet bowling alley (12A) having at least one event sheet bowling pin (12B) and a event sheet foul line (12E), the event sheet (12) further comprises at least one event sheet forward bowling ball marker (12C), the event sheet (12) further comprises at least one event sheet rearward bowling ball marker (12D), the event sheet foul line (12E) further comprises at least one event sheet foul line marker (12EA), the event sheet foul line (12E) further comprises at least one event sheet second foul line marker (12EB), the event sheet foul line (12E) further comprises at least one event sheet first foul line marker (12EC);

B) an opaque sheet (14) positioned under the event sheet (12);

C) a board (16) which comprises dark colored board wax (16A) covering a board support (16B), the dark colored board wax (16A) is positioned under the opaque sheet (14); and D) a binding (18) positioned longitudinally along one edge of the visual aid for describing sporting events (10), the binding (18) securely attaches the event sheet (12) and the opaque sheet (14) and the board (16) together, when a user applies pressure with a writing instrument on the event sheet (12), the pressure causes the dark colored board wax (16A) to adhere to the opaque sheet (14) exhibiting the writing through the transparent event sheet (12), when the user is finished writing, he or she separates the opaque sheet (14) from the board (16) thereby erasing the writing.

2. The visual aid for describing sporting events (10) as described in claim 1, wherein the event sheet (12) and the opaque sheet (14) are manufactured from plastic or plastic composite.

3. The visual aid for describing sporting events (10) as described in claim 1, wherein the board support (16B) is manufactured from a material selected from a group consisting of plastic, plastic composite, metal, metal alloy, wood, wood composite, cardboard, rubber, rubber composite, fiberglass, epoxy, and carbon-graphite.

* * * * *